US008819982B2

(12) United States Patent
Battaglia

(10) Patent No.: US 8,819,982 B2
(45) **Date of Patent: *Sep. 2, 2014**

(54) PRECISION RIFLE CHASSIS SYSTEM

(76) Inventor: Vincent P. Battaglia, Easton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/587,358

(22) Filed: Aug. 16, 2012

(65) Prior Publication Data

US 2012/0304520 A1 Dec. 6, 2012

Related U.S. Application Data

(63) Continuation of application No. 12/886,652, filed on Sep. 21, 2010, now Pat. No. 8,307,575.

(51) Int. Cl.
*F41A 11/00* (2006.01)

(52) U.S. Cl.
CPC ..... *F41A 11/00* (2013.01)
USPC ..... 42/75.03

(58) Field of Classification Search
USPC ..... 42/75.03, 75.01, 75.04, 75.02, 71.01, 42/72, 41, 77; 89/128, 140, 141
See application file for complete search history.

(56) References Cited

U.S. PATENT DOCUMENTS

| | | | | | |
|---|---|---|---|---|---|
| 1,588,887 | A * | 6/1926 | Haubroe | 42/75.03 |
| 1,928,871 | A * | 10/1933 | Swebilius | 42/16 |
| 2,345,083 | A * | 3/1944 | Williams | 42/75.01 |
| 3,206,885 | A * | 9/1965 | Dye | 42/75.03 |
| 3,439,441 | A * | 4/1969 | Lawley | 42/75.01 |
| 4,237,638 | A | 12/1980 | Trexler | |
| 4,312,146 | A * | 1/1982 | Koon, Jr. | 42/75.03 |
| 4,385,464 | A * | 5/1983 | Casull | 42/75.03 |
| 4,679,487 | A * | 7/1987 | Houseman | 89/140 |
| 4,691,462 | A | 9/1987 | Mattarelli | |
| 6,487,805 | B1 | 12/2002 | Reynolds | |
| D610,218 | S | 2/2010 | Barrett | |
| 7,665,240 | B1 | 2/2010 | Bentley | |
| 7,685,757 | B2 | 3/2010 | Rohrauer | |
| 7,726,060 | B1 | 6/2010 | Jones | |
| 7,841,119 | B1 * | 11/2010 | Boyd | 42/71.01 |
| 8,015,740 | B2 * | 9/2011 | Jamison et al. | 42/69.02 |
| 8,079,169 | B2 * | 12/2011 | Gregg | 42/75.03 |
| 2009/0288324 | A1 | 11/2009 | Peterson et al. | |
| 2010/0083551 | A1 * | 4/2010 | Jamison | 42/75.01 |

* cited by examiner

*Primary Examiner* — Reginald Tillman, Jr.
(74) *Attorney, Agent, or Firm* — DeLio, Peterson & Curcio, LLC.; Peter W. Peterson

(57) ABSTRACT

A rifle assembly includes a central chassis having a vertically aligned opening and a pair of slots extending from the sidewalls into the opening. An action has a pair of projections engageable with the slots in the chassis and is removably securable within the chassis. The action is insertable into and removable from above the chassis, with the action axis at an angle to the chassis axis, to engage the respective action and chassis slot and projection. The action is rotatable with respect to the chassis upon engagement of the respective action and chassis slot and projection to align the axes of the action and chassis and lock the action to the chassis against rotation and removal. A resilient material is disposed between the chassis and action to load the action to the chassis with a force in excess of recoil force of the action.

10 Claims, 4 Drawing Sheets

PRECISION RIFLE CHASSIS SYSTEM

This application is a continuation of U.S. Ser. No. 12/886,652, filed on Sep. 21, 2010.

BACKGROUND OF THE INVENTION

1. Field of the Invention

This invention relates to a modular chassis system for a rifle.

2. Description of Related Art

The rifle is comprised of three basic sections so that it is capable of being fired from a shoulder mounted position in standing, sitting or prone. These sections comprise the butt stock, action-trigger area and the fore end. The feature level and configuration of these sections determine the class of rifle, for example, sporting, tactical or a hybrid sporting-tactical dual use weapon. International Traffic in Arms Regulations (ITAR) and other state and federal regulations also define rifle configurations and classifications. Further, there are myriad possible caliber and barrel length configurations for rifles. It would be advantageous to have a modular rifle system that can adapt to these varied requirements.

SUMMARY OF THE INVENTION

Bearing in mind the problems and deficiencies of the prior art, it is therefore an object of the present invention to provide easy interchangeability of rifle actions and barrels and/or removable yet secure fastening of modular rifle components.

Still other objects and advantages of the invention will in part be obvious and will in part be apparent from the specification.

The above and other objects, which will be apparent to those skilled in the art, are achieved in the present invention which is directed to a rifle assembly comprising a central chassis having front and rear portions, side walls between the front and rear portions and a vertically aligned opening between the side walls, and an insert removably securable within the vertically aligned chassis opening. The assembly further includes an action removably securable within the insert and including a trigger guard. The insert and action are insertable into and removable from the vertically aligned opening above the chassis, with the trigger guard extending below the chassis when the insert and action are secured within the chassis.

The central chassis, insert and action each have a longitudinal axis and the insert and action may be pivotably securable within the chassis from a position wherein the insert and action axes are at an angle to the chassis axis to a position wherein the insert and action axes are aligned with the chassis axis. The insert and action are securable in position in the chassis, for example, by a latch, when the axes of the insert, action and chassis are aligned. The chassis may have at least one projection or slot and the insert may have at least one slot or projection engageable with the at least one projection or slot in the chassis, such that the insert is insertable into and removable from the chassis by engagement and disengagement of the at least one projection and slot.

The rifle assembly may include a removably securable forestock extending forward of the central chassis front portion and the action may include a barrel, with the barrel being above the forestock when the action axis is at an angle to the chassis axis. The barrel is received in the forestock when the axes of the insert, action and chassis are aligned and the insert and action are secured in the chassis.

The present invention is also directed to a rifle assembly comprising a central chassis having front and rear portions, side walls between the front and rear portions and a vertically aligned opening between the side walls, and an action removably securable within the chassis and including a trigger guard. The action is insertable into and removable from the vertically aligned opening above the chassis, with the trigger guard extending below the chassis when the action is secured within the chassis. The assembly also includes a resilient material between the chassis and action. The resilient material loads the securing of the action to the chassis with a force in excess of recoil force of the action, and may be positioned between the rear portion of the chassis and the action.

The action may include a removably securable insert receivable in the vertically aligned chassis opening, and the resilient material may be between the chassis and the insert. The central chassis and action may each have a longitudinal axis and the action may be pivotably securable within the chassis from a position wherein the action axis is at an angle to the chassis axis to a position wherein the action axis is aligned with the chassis axis.

In another aspect, the present invention is directed to a rifle assembly comprising a central chassis having a longitudinal axis, front and rear portions, side walls between the front and rear portions and a vertically aligned opening between the side walls, and an action having a longitudinal axis and pivotably securable within the chassis from a position wherein the action axis is at an angle to the chassis axis to a position wherein the action axis is aligned with the chassis axis. The action is securable in position in the chassis when the axes of the action and chassis are aligned. The chassis has at least one projection or slot and the action has at least one slot or projection engageable with the at least one projection or slot in the chassis. The action is insertable into and removable from the chassis by engagement and disengagement of the at least one projection and slot.

In a further aspect, the present invention is directed to a rifle assembly comprising a central chassis having a longitudinal axis, front and rear portions, side walls between the front and rear portions and a vertically aligned opening between the side walls. The chassis has at least one projection or slot extending from the sidewalls into the opening. The rifle assembly also comprises an action having a longitudinal axis and removably securable within the chassis, with the action having at least one slot or projection engageable with the at least one projection or slot in the chassis. The action is insertable into and removable from above the chassis, with the action axis at an angle to the chassis axis, to engage the respective action and chassis slot and projection. The action is rotatable with respect to the chassis upon engagement of the respective action and chassis slot and projection to align the axes of the action and chassis and lock the action to the chassis against rotation and removal. A latch in either or both of the action or chassis locks the action to the chassis. The action may include a trigger guard extending below the chassis when the action is locked to the chassis.

The rifle assembly may further include a butt stock removably securable to the rear portion of the chassis. The butt stock may have a pair of coupler openings and the chassis may have a pair of coupler openings at the rear portion. The respective pairs of chassis and butt stock coupler openings are alignable to permit insertion of a tie-bolt through the coupler openings to removably secure the butt stock to the rear portion of the chassis. The butt stock or chassis may have a central coupler opening aligned between the pair of coupler openings to receive the tie-bolt. The tie-bolt may have an opening therethrough, normal to the tie-bolt axis, and further include a fastener securable within the tie-bolt opening to secure the tie-bolt to the chassis. The pair of chassis openings may be obround to permit movement of the tie-bolt normal to the tie-bolt axis upon securing the fastener within the tie-bolt opening.

In yet another aspect, the present invention is directed to a method of assembling a modular rifle comprising providing a central chassis having a longitudinal axis, front and rear portions, side walls between the front and rear portions and a vertically aligned opening between the side walls, and providing an action having a longitudinal axis. The method then includes pivotably securing the action within the chassis at a position wherein the action axis is at an angle to the chassis axis to a position, rotating the action to align the action axis with the chassis axis, and securing, the action in position in the chassis when the axes of the action and chassis are aligned.

In a further aspect, the present invention is directed to a method of assembling and disassembling a modular rifle comprising providing a central chassis having front and rear portions, side walls between the front and rear portions and a vertically aligned opening between the side walls, providing an insert removably securable within the vertically aligned chassis opening, and providing an action removably securable within the insert, the action including a trigger guard. The method then includes securing the action within the insert, thereafter securing the combined insert and action within the vertically aligned opening from above the chassis, the trigger guard extending below the chassis when the insert and action are secured within the chassis, using the action to fire the rifle, thereafter removing the combined insert and action from the chassis, and thereafter removing the action from the insert.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-6 of the drawings in which like numerals refer to like features of the invention.

The present invention employs a center chassis rifle core with attachable means for the fore-end and butt stock in multiple configurations. The butt stock, center chassis core and fore-end are operatively connected in a desired configuration to provide the desired ergonomic configuration of the weapon. The intermediate insert plate of the invention may receive the selected barreled action of caliber choice in either semi-automatic or single shot bolt action type on its top surface and the corresponding trigger guard bottom metal with magazine of specific capacity and type on its bottom surface. The present invention provides a means to adaptively change the entire barreled action including the fire control and trigger guard as a single assembly from the chassis core with no tools and quickly replace it with another assembly.

The present invention allows the rifle to be changed by two major assemblies—the mechanical barreled action with intermediate plate and the ergonomic rifle stock. The center chassis core is able to receive any desired caliber configuration of barreled action and bottom metal mounted to the intended intermediate plate. In one embodiment, the intermediate plate is configured with trunnion lock plates on either side to be received by a headed boss of specific location inside the chassis core. This allows the assembled intermediate plate with its barreled action and bottom metal trigger guard to be inserted into the chassis core engaging the trunnion plate with its associative headed bosses and rotate to the chosen centerline and locking using a latch closure. Upon closure of the latching mechanism a resilient member such as a coil spring may be compressed on the far angled surface of the intermediate plate to provide a pre-determined load to unify the barreled assembly with the chassis assembly.

The interface of the butt-stock and fore-end to the center chassis core may employ a joint design of interlocking geometry for secure fastening that is still easily removable.

Figure 1:
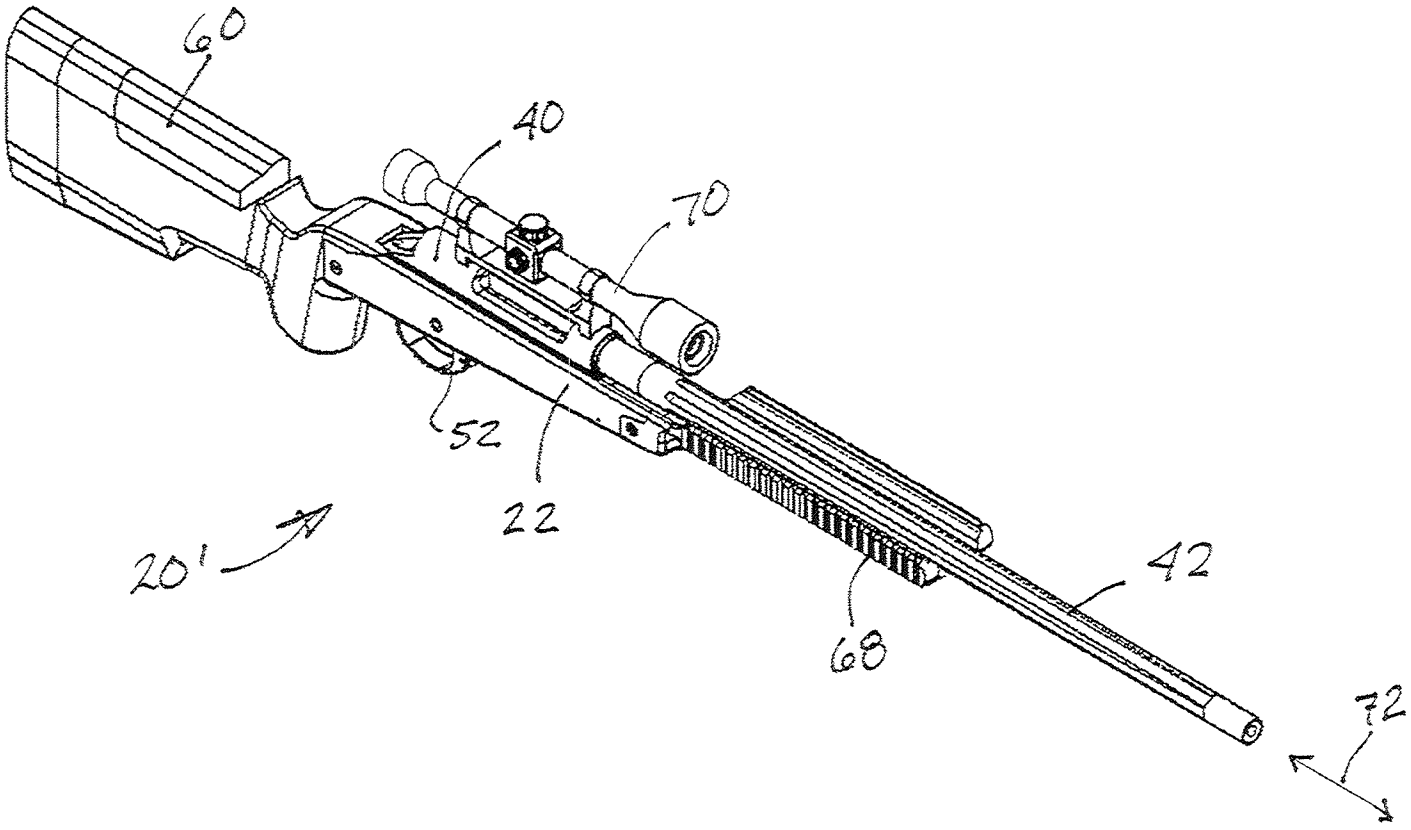
FIG. 1 is a perspective view of the assembled rifle made from an embodiment of the modular chassis system of the present invention.
Figure 4:
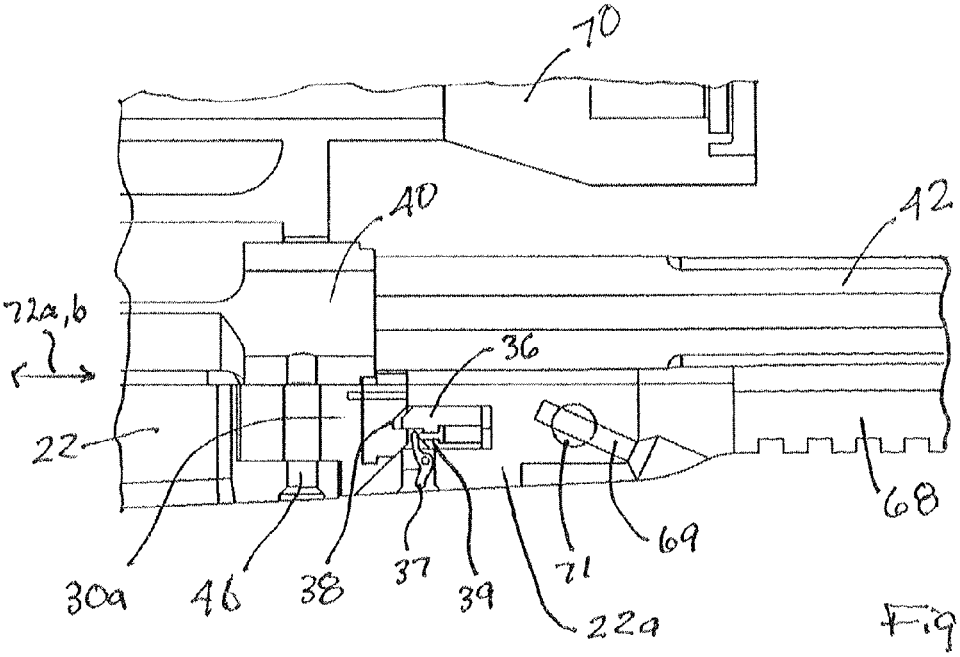
FIG. 4 is a side cross-sectional elevational view of the insert and action assembly locked into the chassis of the rifle assembly of FIG. 1.
Figure 5:
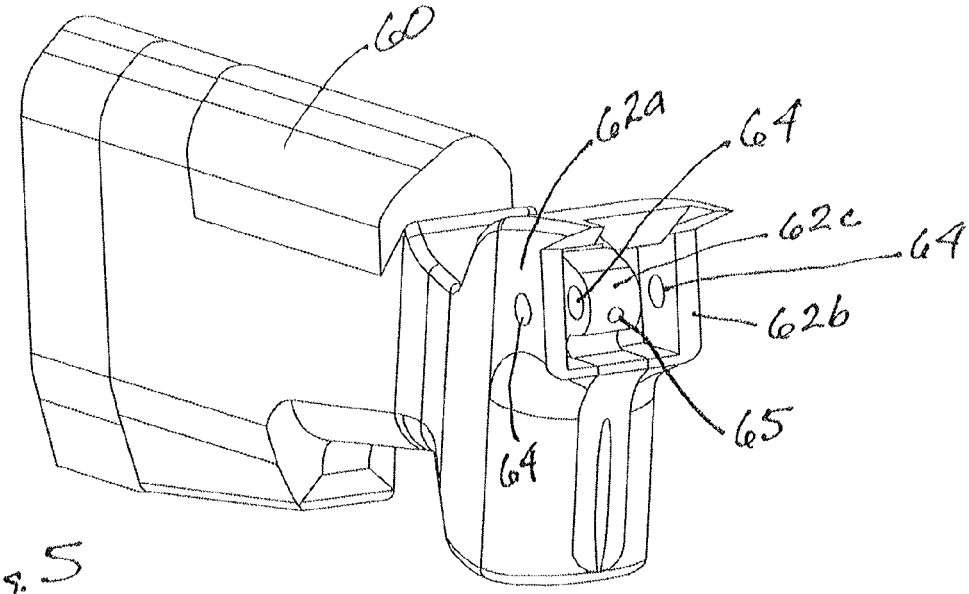
FIG. 5 is a perspective view of the butt stock portion of the joint used for removably securing the butt stock to the chassis of the rifle assembly of FIG. 1.
Figure 6:
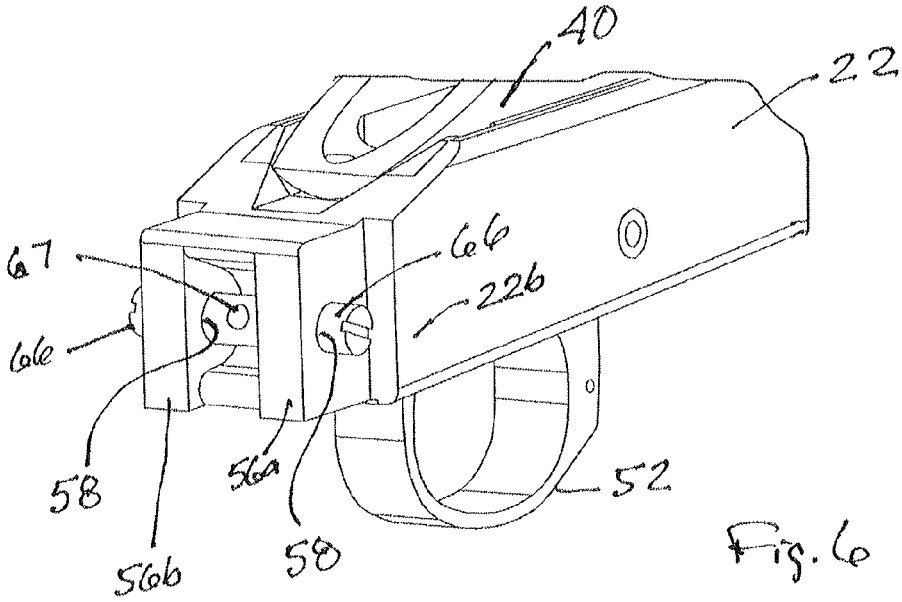
FIG. 6 is a perspective view of the chassis portion of the joint used for removably securing the butt stock to the chassis of the rifle assembly of FIG. 1.

The modular chassis system 20 used to create the completed rifle assembly (FIG. 2) includes a central chassis 22 having front 22*a* and rear 22*b* portions aligned along longitudinal axis 72*b*, which is parallel to the longitudinal axis 72 of the assembled rifle 20' (FIG. 1). Sidewalls 24*a*, 24*b* are disposed between the front and rear portions of the central chassis and define a vertically aligned opening 26 therebetween. The central chassis may be made of a metal or alloy such as forged aluminum, a composite material, or a combination such as a sheet steel stamping molded into a polymer. The chassis system may include at the fore-end a removable forestock 68 extending forward of the central chassis front portion 22*a* to receive the rifle barrel, and at the rear end a removable butt stock 60 that contacts the user's shoulder during firing. Forestock 68 may be secured to the central chassis by threaded fastener 69 removably secured in a transverse threaded opening in pin 71 extending horizontally through chassis front portion 22*a* (FIG. 4). Unless otherwise noted, all directions are with respect to the completed rifle assembly as normally fired with axis 72 in the horizontal position.

A plurality of replaceable rifle actions 40 may be provided to permit the chassis system to fire different calibers, sizes and types of ammunition cartridges. The rifle action 40 may be a bolt-type or other working mechanism to mechanically load a cartridge from a magazine and fire it through barrel 42, including automatic, semi-automatic, lever or side lock actions. A trigger guard 52 enclosing trigger 54 may be contained in bottom metal 50, which may be removably securable to the underside of action 40. A magazine may be clipped to the underside of action 40 in front of the trigger guard. To removably secure the action 40 and bottom metal 50 within the central chassis 22, a separate intermediate insert plate 30 is provided. Insert 30 has front and rear portions 30*a*, 30*b*, respectively, and sidewalls 31*a*, 31*b* disposed between the front and rear portions that define a vertically aligned opening 33. The action 40 with barrel 42 and bottom metal 50 may be removably secured by threaded fasteners 46 to the top and bottom, respectively, of insert 30, and the resulting assembly may then be removably secured within central chassis 22 from above the central chassis opening 26. A sighting scope 70 may be secured over action 40 as part of the assembly. After being secured in firing position, insert 30 has longitudinal axis 72*b* that is aligned with the longitudinal axis of the central chassis and the trigger guard extends below the central chassis for firing.

Figure 2:
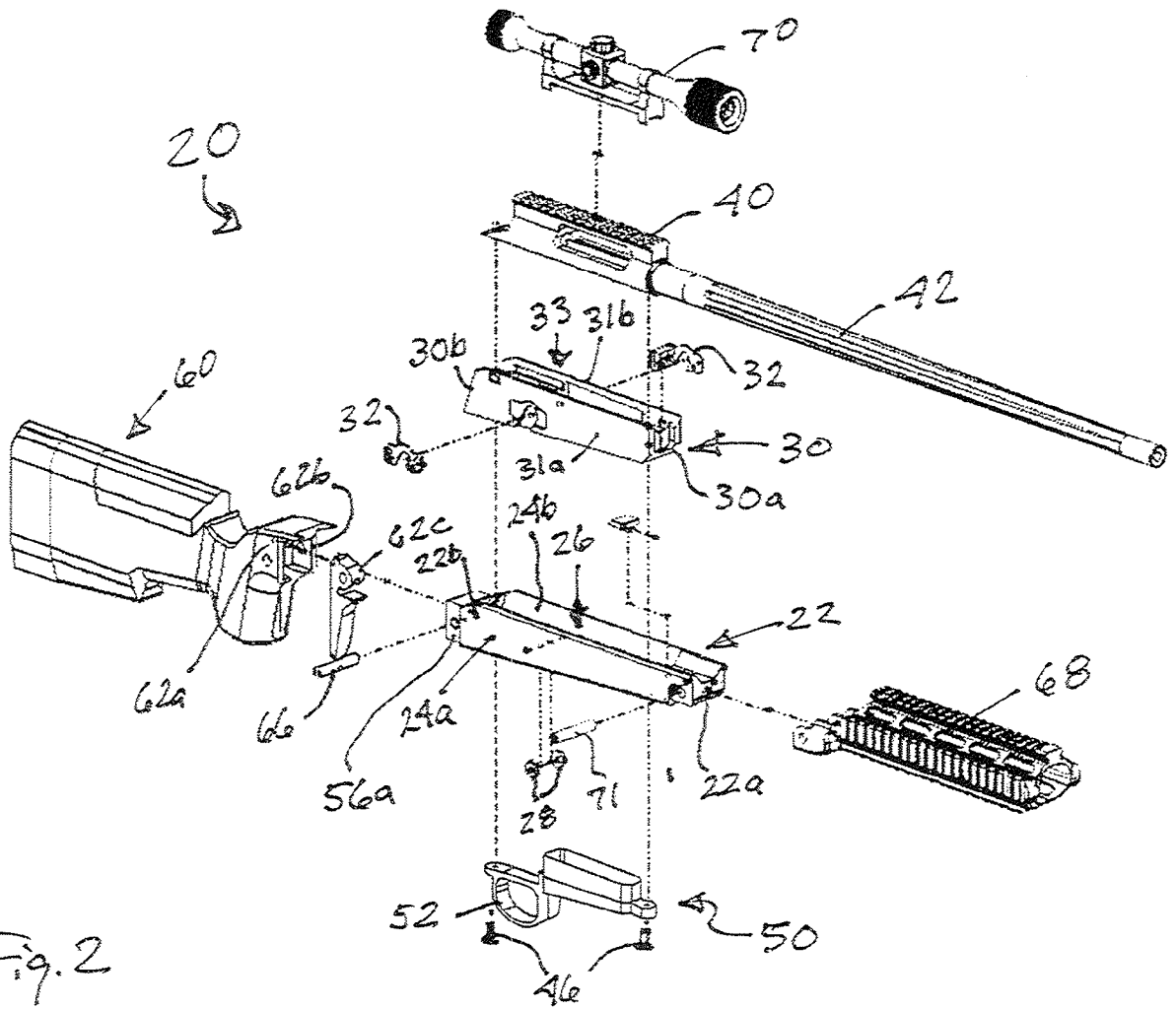
FIG. 2 is an exploded perspective view of the rifle of FIG. 1 showing some of the components of the modular chassis system of the present invention.
Figure 3:
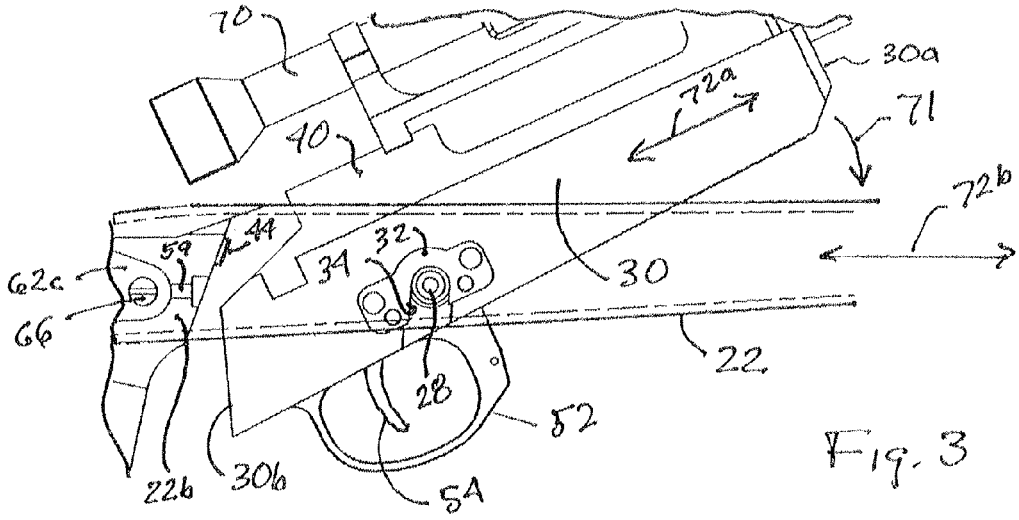
FIG. 3 is a side cross-sectional elevational view of the insert and action assembly being pivotally engaged with the chassis of the rifle assembly of FIG. 1.

As shown by way of example, the assembled insert 30 and action 40 are pivotably securable within central chassis 22. As shown in FIGS. 2 and 3, insert 22 has mounted on the exterior of each of sidewalls 24*a*, 24*b* a trunnion support plate 32 having a slot 34 extending upward from the lower portions at an acute angle to axis 72*a*. Central chassis 22 has extending inwardly from the interior of each of sidewalls coaxially projecting complimentary trunnions or headed bosses 28 for sliding insertion into slots 34. Alternately, slots 34 are provided on chassis 22 and engageable projections 28 are provided on insert 30. The insert 30 and action 40 assembly is insertable into and removable from the chassis by respective engagement and disengagement of one or more of the projections and slots. Upon insertion of bosses 28, the trunnion support plate and slot act as a socket to permit pivoting of the bosses and insert and action assembly with respect to the central chassis. Initially, the insert longitudinal axis is at an angle to the central chassis axis when the projections 28 are inserted into the slots (FIG. 3). Thereafter, the front portion of insert 30 (with action 40) is rotated in the direction of arrow 71 to a position wherein the insert axis 72*a* is aligned with the chassis axis 72*b*. Since the barrel axis is aligned with the action axis, barrel 42 also rotates from a position above forestock 68 when the insert and action are initially inserted into the central chassis axis, to a position aligned with and received in the forestock when the axes of the insert, action and chassis are aligned and the insert and action are secured in the chassis.

Once the insert, action, barrel and central chassis are aligned, the insert is locked or other secured in such operational position in the center chassis. As shown in FIG. 4, a spring-loaded latch bolt 36 slides within a slot 35 extending rearward from the front portion 22*a* of central chassis 22 and may engage a strike or opening 38 in the front portion of insert 30. Upon locking of the insert, action, barrel and central chassis, the rifle assembly is ready for firing operation. To release and remove the insert, a finger-operated pivoted lever 37 within a downward opening in chassis portion 22*a* may engage a pin 39 and latch bolt 36 to urge the latch bolt forward out of strike 38 to permit the front portion of insert 30 to rotate upward around bosses 28 and trunnion slot 34. The insert and action assembly may then be removed by rotating the front portion upwardly from the central chassis and then lifting the insert and action assembly out of the chassis. Both assembly and disassembly of the insert and action with the central chassis may be accomplished without tools.

To further load the insert and action assembly within the central chassis when they are secured in firing position, a resilient member 44 may be employed between the action and the chassis. By way of example, resilient member 44 may be placed in a pocket in the chassis rear portion 22*b*, partially extending into opening 26 (FIG. 3). The face of insert rear portion 30*b* may then contact and compress the resilient member when the insert/action and central chassis axes are aligned, to place a compressive load on the resilient material in longitudinal direction 72 in excess of the expected recoil force during filing. The load may be up to three or more times of the amount of recoil force. The resilient member may be a spring, a polymeric material, or any other suitable resilient material.

As used herein, the terms "removably secure" and "removably securable" means that the component or part may be locked or otherwise secured into position for use in firing the gun, and may be repeatedly removed or disassembled as desired by the user, without impairing the usefulness of the gun. Mechanical or other reusable means may be employed to removably secure the parts or components in the gun for firing, such as those described herein. These terms exclude the use of permanent or semi-permanent securing means such as adhesives or rivets.

Butt stock 60 may be of any type, including fixed and folding. To removably secure it in the rifle assembly, both the front portion of butt stock 60 and the rear portion 22*b* of central chassis 22 may employ opposing and complimentary coupler joints that are connected by a tie bar, as shown in more detail in FIGS. 5 and 6. The butt stock coupler joint as shown has a pair of extending outer flanges 62*a*, 62*b* and an inner male projection 62*c* therebetween, all with coaxially aligned openings 64. Since the butt stock may be made of fiberglass or other lightweight polymer or composite, for joint strength couple projection 62*c* may be a separate alloy component, such as forged aluminum, with a downwardly extending tang permanently adhered within a comparable opening in the front portion of butt stock 60. The chassis coupler joint as shown has a pair of extending outer flanges 56*a*, 56*b* with coaxially aligned openings 58. The chassis flanges 56*a*, 56*b* are sized and configured to fit between the butt stock outer flanges 62*a*, 62*b* and projection 62*c*. A tie-bolt 66 (shown in the chassis coupler joint, FIG. 6) may be sized to fit tightly but slideably through all openings 58, 64 when the chassis and butt stock coupler joints are mated and the openings are aligned. Tie-bolt 66 may have a tapped opening 67 through the center, normal to the tie-bolt axis, which may be aligned with a similarly sized opening 65 in butt stock male projection 62*c*. A threaded fastener 59 may be inserted through butt stock opening 65 and into tie-bolt opening 67 (FIG. 3). The pair of chassis coupler openings 58 may be obround to permit slight movement of the tie-bolt normal to the tie-bolt axis, upon securing fastener 59 within the tie-bolt opening, to tighten the butt stock-chassis joint to a desired load.

Thus, the present invention provides easy interchangeability of rifle actions and barrels without use of tools, and removable yet secure fastening of the modular rifle components. A single central chassis may accommodate different action, barrel, bottom metal, forestock and butt stock components to modify the rifle as desired to sporting, tactical or hybrid sporting-tactical use with different action, caliber and barrel length configurations.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rifle assembly comprising:

a central chassis having side walls and a vertically aligned opening between the side walls;

an action removably securable within the chassis and including a trigger guard, the action being insertable into and removable from the vertically aligned opening above the chassis, the trigger guard extending below the chassis when the action is secured within the chassis; and a resilient material between the chassis and action, the resilient material loading the securing of the action to the chassis with a force in excess of recoil force of the action.

2. The rifle assembly of claim 1 wherein the resilient material is between a rear portion of the chassis and the action.

3. A rifle assembly comprising:

a central chassis having side walls and a vertically aligned opening between the side walls;

an action removably securable within the chassis and including a trigger guard, the action being insertable into and removable from the vertically aligned opening above the chassis, the trigger guard extending below the chassis when the action is secured within the chassis, the action being disposed within a removably securable insert receivable in the vertically aligned chassis opening; and a resilient material between the chassis and the insert.

4. A rifle assembly comprising:

a central chassis having side walls and a vertically aligned opening between the side walls;

an action removably securable within the chassis and including a trigger guard, the action being insertable into and removable from the vertically aligned opening above the chassis, the trigger guard extending below the chassis when the action is secured within the chassis, the action including a removably securable insert receivable in the vertically aligned chassis opening; and a resilient material between the chassis and action;

wherein the central chassis and action each have a longitudinal axis and the action is pivotably securable within the chassis from a position wherein the action axis is at an angle to the chassis axis to a position wherein the action axis is aligned with the chassis axis, the action being securable in position in the chassis when the axes of the action and chassis are aligned.

5. The rifle assembly of claim 4 further including a latch in the action or chassis to secure the action in position in the chassis when the axes of the action and chassis are aligned.

6. A rifle assembly comprising:

a central chassis having a longitudinal axis, side walls and a vertically aligned opening extending between the side walls completely through the chassis, the chassis having at least one projection or slot extending from the sidewalls into the opening; and an action having a longitudinal axis and removably securable within the chassis, the action having at least one slot or projection engageable with the at least one projection or slot in the chassis, the action being insertable into and removable from above the chassis, with the action axis at an angle to the chassis axis, to engage the respective action and chassis slot and projection, the action being rotatable with respect to the chassis upon engagement of the respective action and chassis slot and projection to align the axes of the action and chassis and lock the action to the chassis against rotation and removal.

7. The rifle assembly of claim 6 further including a latch in the action or chassis to lock the action to the chassis.

8. A rifle assembly comprising:

a central chassis having a longitudinal axis, side walls and a vertically aligned opening between the side walls, the chassis having at least one projection or slot extending from the sidewalls into the opening; and an action having a longitudinal axis and removably securable within the chassis, the action having at least one slot or projection engageable with the at least one projection or slot in the chassis, the action being insertable into and removable from above the chassis, with the action axis at an angle to the chassis axis, to engage the respective action and chassis slot and projection, the action being rotatable with respect to the chassis upon engagement of the respective action and chassis slot and projection to align the axes of the action and chassis and lock the action to the chassis against rotation and removal, the action including a removably securable insert receivable in the vertically aligned chassis opening.

9. A rifle assembly comprising:

a central chassis having a longitudinal axis, opposing side walls and a vertically aligned opening between the side walls, the chassis having a pair of projections or slots extending into the opening, one of the pair of projections or slots extending from one of the opposing side walls and the other of the pair of projections or slots extending from the other of the opposing side walls; and an action having a longitudinal axis and removably securable within the chassis, the action having a pair of slots or projections engageable with the pair of projections or slots in the chassis, the action being insertable into and removable from above the chassis, with the action axis at an angle to the chassis axis, to engage the respective action and chassis slot and projection, the action being rotatable with respect to the chassis upon engagement of the respective action and chassis slot and projection to align the axes of the action and chassis and lock the action to the chassis against rotation and removal.

10. The rifle assembly of claim 9 wherein the vertically aligned opening of the central chassis extends between the side walls completely through the chassis.

* * * * *